US006997681B2

(12) United States Patent
Moore

(10) Patent No.: US 6,997,681 B2
(45) Date of Patent: Feb. 14, 2006

(54) ADJUSTABLE AIR SEAL ON A FAN HUB

(75) Inventor: R. David Moore, Marceline, MO (US)

(73) Assignee: Moore Fans LLC, Marceline, MO (US)

( * ) Notice: Subject to any disclaimer, the term of this patent is extended or adjusted under 35 U.S.C. 154(b) by 122 days.

(21) Appl. No.: 10/801,635

(22) Filed: Mar. 16, 2004

(65) Prior Publication Data

US 2004/0184918 A1 Sep. 23, 2004

Related U.S. Application Data

(60) Provisional application No. 60/455,181, filed on Mar. 17, 2003.

(51) Int. Cl.
*F01D 5/22* (2006.01)

(52) U.S. Cl. ..... 416/196 A; 416/210 A; 416/211

(58) Field of Classification Search ..... 416/210 A, 416/210 R, 205, 207, 146 A, 211, 193 R, 416/194, 196 A, 196 R; 415/173.2, 173.3
See application file for complete search history.

(56) References Cited

U.S. PATENT DOCUMENTS 4,187,056 A * 2/1980 Schwinn et al. ..... 416/207

6,022,191 A 2/2000 Moore et al.

* cited by examiner

*Primary Examiner*—Edward K. Look
*Assistant Examiner*—Devin Hanan
(74) *Attorney, Agent, or Firm*—Christie, Parker & Hale, LLP

(57) ABSTRACT

An axial flow fan has a hub with a plurality of hub struts extending radially from the hub for mounting a blade on the end of each hub strut. Inner and outer studs extend in the axial direction of the fan on each of the hub struts. An air seal covers the hub struts, and particularly the space between the hub struts. The air seal has a generally round central sheet and a number of radially adjustable segments extending radially from the central sheet corresponding to the number of hub struts. Each of the segments is a generally trapezoidal sheet spanning the space between adjacent hub struts. Inner and outer slots along each of the radial edges of the trapezoidal sheet extend in a direction parallel to a radial line through the center of the sheet with each slot engaging a stud on a hub strut. This permits the segments to be adjusted radially to closely match the roots of the blades before nuts are tightened on the threaded studs. As illustrated, each segment has an outer edge with an axially extending first wall portion normal to one adjacent hub strut and a second axially extending wall portion normal to the other adjacent hub strut. Thus, adjacent segments form a "shroud" parallel to the root of an adjacent blade for an effective air seal. A step along each radially extending edge stiffens the segment and connects to a flange having the slots.

25 Claims, 3 Drawing Sheets

ADJUSTABLE AIR SEAL ON A FAN HUB

CROSS-REFERENCE TO RELATED APPLICATIONS

This application claims priority of U.S. Provisional Patent Application Ser. No. 60/455,181, filed Mar. 17, 2003.

BACKGROUND

This invention relates to an air seal on the hub of a large axial flow fan. The air seal covers the annulus between the hub and inner ends of fan blades.

Large industrial axial flow fans having diameters ranging from about one to ten meters or more are commonly used for moving air through cooling towers, heat exchangers and the like. A typical fan in such an application may have a diameter of about five meters and anywhere from eight to eighteen airfoil-shaped blades coupled to a rotatable hub.

An exemplary mounting arrangement for the blades on large fans has a hub which fits on the drive shaft and a number of radially extending hub struts to which the blades are somewhat flexibly connected. The connection permits the blades to have limited motion in the axial direction, adjustment for pitch, and adjustment for radial length. The latter is important since the gap between the tip of the blades and the surrounding shroud should be small so that air "leakage" between the tips and shroud is relatively small. Air that may flow from the higher pressure downstream face of the fan to the lower pressure upstream face represents a loss of efficiency. A gap is, of course, important so that the ends of the blades do not collide with the shroud. Radial adjustment of the effective length of the blades allows the installer to have a small and uniform gap.

Air "leakage" at the inner ends of the blades should also be limited to promote fan efficiency. For smaller fans and those with fixed blades, a circular sheet of metal overlying the hub and covering any annulus between the hub and inner ends of the blades can form an effective air seal. For larger fans, and particularly for those with adjustable blades, a polygonal air seal closer to the inner ends of the blades is desirable. Furthermore, in addition to a flat sheet spanning the annulus, it may be desirable to have some axial extent of the air seal to minimize leakage around the downstream portions of the inner ends of the blades. In effect, the air seal is a shroud at the inner ends of the blades, that rotates with the blades.

When the diameter of the air seal at the hub of the fan becomes large, there can be problems in forming the air seal from a simple circular or polygonal sheet of metal. A structure for making increasingly large air seals is therefore desirable.

BRIEF SUMMARY OF THE INVENTION

There is, therefore, provided in practice of this invention an air seal for an axial flow fan comprising a generally round central sheet and a plurality of radially adjustable segments extending radially from the central sheet. Such a fan has a hub with a plurality of hub struts extending radially from the hub. A blade is mounted on each of the hub struts. Studs extend in the axial direction of the fan on each of the hub struts. Each of the segments of the air seal comprises a generally trapezoidal sheet spanning the space between adjacent hub struts with a plurality of slots near the radially extending edges of the sheet. Each slot extends in a direction parallel to a radial line through the center of the segment. The slots fit over the studs on the hub struts.

DESCRIPTION

Figure 1:
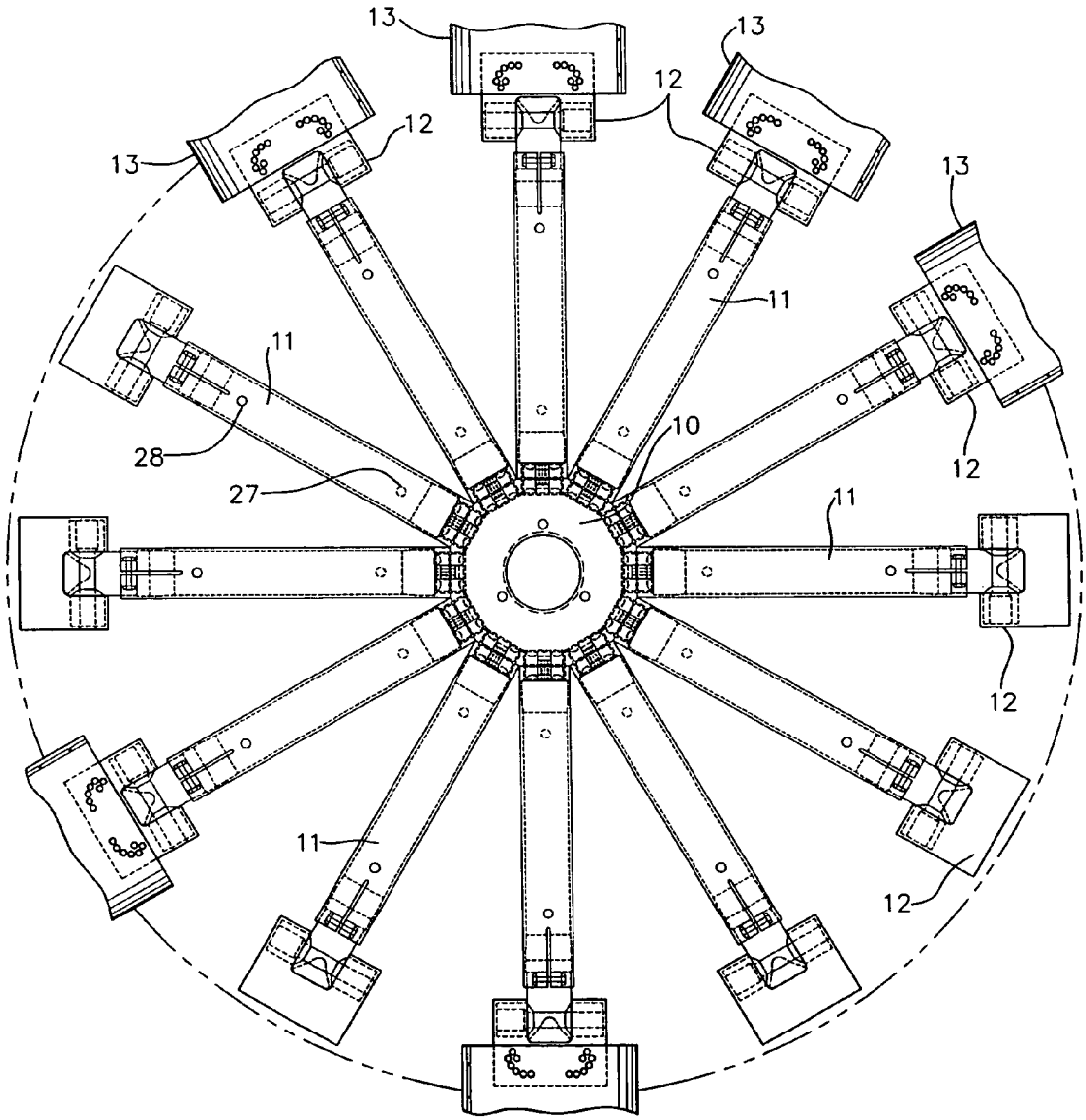
FIG. 1 illustrates in plan view a fan hub, hub struts and some blade ends of a large axial flow fan.
Figure 2:
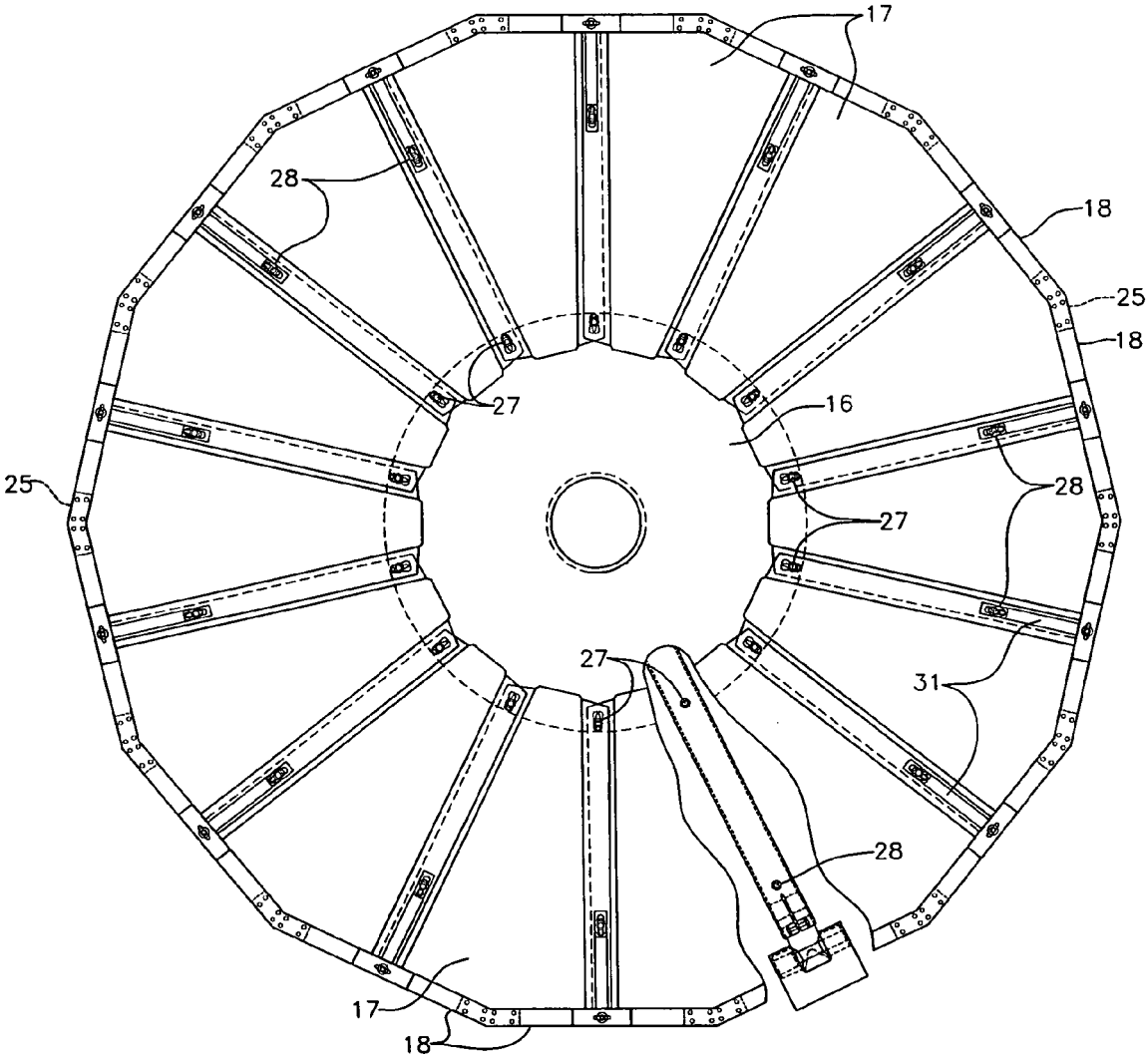
FIG. 2 is a plan view of the air seal installed on the fan.
Figure 3:
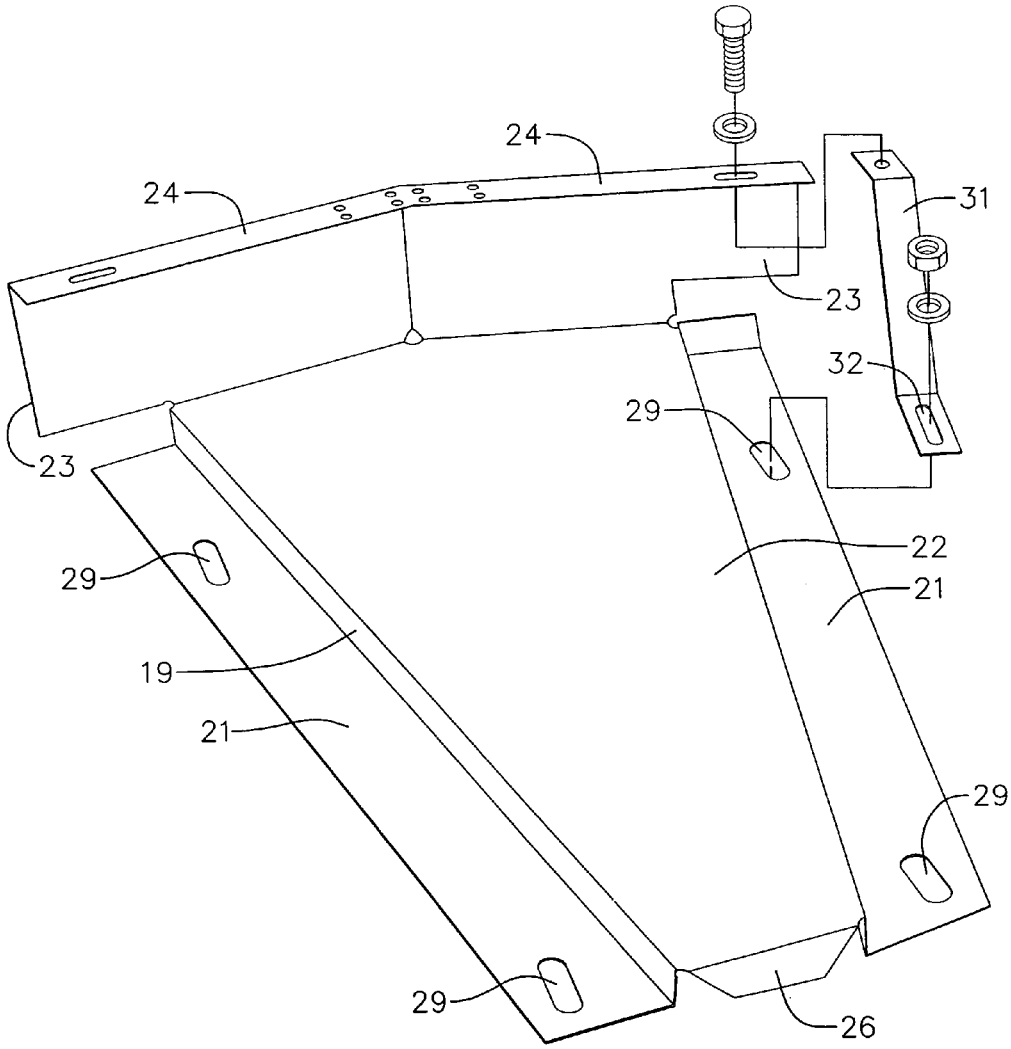
FIG. 3 is a perspective view of an air seal segment.

A way of mounting blades on a large diameter axial flow fan is described and illustrated in U.S. Pat. No. 6,022,191, the subject matter of which is hereby incorporated by reference. Such a large diameter axial flow fan has a central hub 10 which mounts on the drive shaft for the fan. A number of blade supporting hub struts 11 are connected to the hub and extend radially. A blade mounting structure 12 described in detail in the aforementioned patent, is at the end of each of the hub struts. Each of these mounting members connects to a blade 13. Only an end fragment of such a blade is illustrated since details of the mounting structure and blade are conventional and unimportant for understanding the structure of the air seal.

As previously indicated, an air seal is provided on the hub to cover the hub (to the extent required) and hub struts, and most importantly the space between the hub struts. The adjustable air seal for a large diameter fan has a central generally round sheet 16. Although it is conveniently made circular, as illustrated, the central sheet may be polygonal and only approximately circular. Also, instead of flat, the sheet may be domed or otherwise shaped to better conform to the hub or provide structural stiffness. A number of radially adjustable segments 17 extend radially outwardly from the central sheet. The number of segments corresponds to the number of hub struts, i.e., the number of spaces between hub struts. The central sheet and segments are conveniently stamped and/or bent from 0.8 mm thick aluminum alloy sheet.

Each of the segments is generally trapezoidal in plan view. (As a segment of a ring, it could also be considered generally triangular.) "Generally trapezoidal" is a convenient shorthand for characterizing the segment even though it is preferred to be a five-sided polygon with the outer edge of the segment having two straight portions 18. For fans with larger numbers of blades the two straight portions are at such a small angle from each other that the segment appears approximately trapezoidal. Each radially extending side edge of the segment has a step 19 to a flange 21. Each flange overlies one of the hub struts and the central generally trapezoidal area 22 of the segment overlies (and seals) the space between adjacent hub struts.

At the outer edge of each segment there is a pair of straight walls 23 extending in the axial direction of the fan. Each straight portion of the wall is perpendicular to (or normal to) the nearest hub strut and therefore generally parallel to the root of a blade mounted on the nearest hub strut. It will be noted that when assembled on the fan hub and struts, the walls on adjacent segments form a straight wall parallel to the blade root. At the top of each of the two walls on a segment there is a lip 24 extending toward the center of the hub and generally parallel to the central area 22 of the segment. A doubler 25 (hidden in the plan view) is riveted or spot welded to the adjacent lips on the walls of the segment for stiffening and securing the walls together.

At the inner end of each segment (i.e., nearer the hub), a tab 26 is folded down so as to approximately engage the central sheet 16 of the air seal. The tab provides stiffening and helps close any gap between the central area of the segment and the generally circular central sheet. Since the segment is made of relatively thin sheet aluminum, stiffening by the inner tab, the radially extending side steps 19 and interconnected walls 23 at the outer edge is desirable. If further stiffening is desired (instead of using thicker sheet), additional folds or stiffening ribs may be added in the central generally trapezoidal area of the segment. Conversely, the generally trapezoidal segment may be made essentially flat without the inner tab, side steps or outer walls, where the metal sheet is sufficiently stiff without these bends. Such "flat" segments may include outer walls for sealing adjacent the blade roots.

Each of the hub struts has an inner stud 27 extending through the edge of the central sheet of the air seal. There is a second outer stud 28 nearer the outer end of each of the hub struts. The two studs on each hub strut extend in the axial direction of the fan.

There are slots 29 in the flanges along each side edge of each segment. The segments are placed on the hub struts so that the two studs on each hub strut pass through respective slots in the edge flanges of the segment. Segments are assembled to cover all of the spaces between hub struts so the flanges on adjacent segments overlap and each stud passes through the two flanges of the adjacent segments.

A generally z-shaped strut 31 is bolted (or riveted or welded) to the inwardly extending lip at the top of the wall. The other end of the strut has a slot 32 that fits over the outer stud on the hub strut. The z-shaped struts stiffen the walls when the entire assembly is bolted together.

The studs are threaded and receive nuts for securing the entire assembly. As desired, one may use elastomeric buffers, washers, lock washers, castle nuts, ordinary nuts or other conventional assembly products to assure a tight, trouble free assembly. When assembled, each of the inner studs secures an edge of the round central sheet and the flanges on adjacent radially extending segments. Similarly, the outer studs secure the outer portions of the flanges on adjacent segments as well as the z-shaped struts.

It will be noted that the slots in the flanges extend in a direct parallel to a radial line through the center of the generally trapezoidal segment. Thus, each segment can be moved radially inwardly or outwardly as appropriate for approaching the inner ends of the adjacent blades. It the segments are made flat instead of with radially extending side flanges, the slots also extend parallel to a radial centerline through the generally trapezoidal segment.

In the illustrated embodiment, the air seal is rather like a shallow bowl placed on top of the hub and hub struts. Thus, the axially extending walls 23 are adjacent to the downstream or trailing edge of the blades. (This alignment is referred to as "top" herein since most of such large fans are used in cooling towers where the fan draws air from within the top of the cooling tower to exhaust upwardly.) An alternative arrangement may be used in the event it is desired to have the axially extending walls be adjacent a greater length of the root of the blades.

In such an arrangement studs are provided on the lower (upstream) side of the hub struts. In effect, the hub is then set down in the center of a generally bowl-shaped air seal. Openings are left at the ends of the outer walls of the segments for clearance around hub struts and/or the blade mounting structure. The hub struts are passed through such holes for connection to the hub, ordinarily before the blades are mounted.

Although described as if the hub and hub struts were set down into the bowl-shaped air seal, it will be apparent that a more convenient way of assembling is to do it upside down with the air seal on top during assembly. It will also be apparent that somewhat different steps, flanges and tabs may be used and/or the walls be made higher than in the illustrated embodiment. The general principles, however, remain the same. Slots in the edges of the generally trapezoidal segments remain parallel to a radial line through the center of the segment so that the radial position of the segment can be adjusted.

Although the segment is generally trapezoidal since the tab 26 is bent down along a straight line, it should be apparent that a more triangular segment is quite equivalent where a tab is carried much nearer the center of the assembly. Such a "tail" at the inner end of the segment is not regarded as changing the overall shape from generally trapezoidal. Similarly, in the illustrated embodiment, the outer walls 23 are straight to parallel the roots of adjacent blades making, in effect, a five-sided "trapezoid". It should be apparent that the segment is generally trapezoidal if the segments are made with a single straight wall (so that they are actually trapezoidal) or if made with a difficult to fabricate curved wall at the outer edge.

If desired, the outer walls on the segments may be curved in the axial direction of the fan to more closely conform to the roots of the blades which are at an angle to the axial direction. This may be desirable in the second embodiment which is not illustrated, where the air seal is on the upstream face of the hub and hub struts. Curved outer walls may also be more efficient aerodynamically.

It is also considered equivalent where two generally trapezoidal segments are formed from a single wider sheet so as to span the two spaces between three hub struts. Such a combining of two segments may or may not be secured to the middle one of the three adjacent hub struts since the joinder of adjacent segments may be made stiff enough that intermediate bolting is not needed. In such an equivalent embodiment, the slots in the radially extending side edges of the segment(s) extend in a direction parallel to the centerline of the combined segments to permit radial adjustment.

What is claimed is:

1. A fan comprising:

a hub;

a plurality of hub struts extending radially from the hub;

inner and outer studs extending in the axial direction of the fan on each of the hub struts;

a blade mounted on each of the hub struts; and an air seal covering the hub struts, the air seal comprising:

a generally round central sheet, and a plurality of radially adjustable segments extending radially from the central sheet, each of the segments comprising:

a generally trapezoidal sheet spanning the space between adjacent hub struts, a plurality of slots near radially extending edges of the trapezoidal sheet, each slot extending in a direction parallel to a radial line through the center of the trapezoidal sheet, each slot engaging a stud on a hub strut.

2. A fan according to claim 1 wherein each trapezoidal sheet comprises:

a generally trapezoidal area; and an L-shaped step along each radially extending edge of the trapezoidal area, the slots being in a portion of the step generally parallel to the trapezoidal area.

3. A fan according to claim 1 wherein each trapezoidal sheet comprises:

a generally trapezoidal area;

a wall extending in the axial direction of the fan along the outer edge of the trapezoidal area, the wall having a first portion normal to one adjacent hub strut and a second portion normal to the other adjacent hub strut.

4. A fan according to claim 3 further comprising a brace connecting an edge of the wall to one of the studs.

5. A fan according to claim 3 wherein each stud is threaded and further comprising a nut securing the trapezoidal sheet to such a stud.

6. A fan according to claim 3 wherein the edges of adjacent trapezoidal sheets overlap and at least a portion of the slots in adjacent trapezoidal sheets are aligned on a stud.

7. A fan according to claim 1 wherein each trapezoidal sheet comprises:

an outer edge with a first wall portion normal to one adjacent hub strut and a second wall portion normal to the other adjacent hub strut.

8. A fan comprising:

a hub;

a plurality of hub struts extending radially from the hub;

inner and outer studs extending in the axial direction of the fan on each of the hub struts;

a blade mounted on each of the hub struts; and an air seal covering the hub struts, the air seal comprising:

a generally round central sheet, and a plurality of radially adjustable segments spanning the space between adjacent hub struts outwardly from the central sheet, each of the segments comprising:

an outer edge with a first portion normal to one adjacent hub strut and a second portion normal to the other adjacent hub strut, and a plurality of slots near radially extending edges, each slot extending in a direction parallel to a radial centerline of the segment, each slot engaging a stud on a hub strut.

9. A fan according to claim 8 wherein each segment comprises:

a central area; and a step and flange parallel to the central area along each radially extending edge of the central area, the slots being in the flanges.

10. A fan according to claim 8 wherein each segment comprises:

a generally trapezoidal area;

a wall extending in the axial direction of the fan along the outer edge of the trapezoidal area.

11. A fan according to claim 10 wherein the wall has a first portion normal to one adjacent hub strut and a second portion normal to the other adjacent hub strut.

12. A fan according to claim 10 further comprising a brace connecting an edge of the wall to one of the studs.

13. A fan according to claim 10 further comprising an inner threaded stud and an outer threaded stud on each hub strut and a nut securing the segment to each such stud.

14. A fan according to claim 10 wherein the edges of adjacent segments overlap and at least a portion of the slots in adjacent segments are on the same stud.

15. A fan according to claim 8 wherein each segment comprises:

an outer edge with a first wall portion normal to one adjacent hub strut and a second wall portion normal to the other adjacent hub strut.

16. A fan comprising:

a hub;

a plurality of hub struts extending radially from the hub;

a blade mounted on each of the hub struts; and an air seal covering the spaces between hub struts, the air seal comprising:

a generally round central sheet, and a plurality of segments spanning the space between adjacent hub struts outwardly from the central sheet, each of the segments comprising:

an outer edge adjacent the roots of at least a pair of blades, and means for radially adjusting the segment and connecting the segment to each of a pair of adjacent hub struts.

17. A fan according to claim 16 wherein the means for adjusting comprises a plurality of slots near radially extending edges of each segment, each slot extending in a direction parallel to a radial centerline through the segment, each slot engaging a stud on a hub strut.

18. A fan according to claim 16 wherein each segment comprises:

a central area; and a step and flange parallel to the central area along each radially extending edge of the central area, a plurality of slots near radially extending edges of each segment, each slot extending in a direction parallel to a radial centerline through the segment, each slot engaging a stud on a hub strut.

19. A fan according to claim 16 wherein each segment comprises:

a generally trapezoidal area;

a wall extending in the axial direction of the fan along the outer edge of the trapezoidal area.

20. A fan according to claim 19 wherein the wall has a first portion normal to one adjacent hub strut and a second portion normal to the other adjacent hub strut.

21. A fan according to claim 19 further comprising a brace connecting an edge of the wall to one of the studs.

22. A fan according to claim 19 wherein the means for connecting comprises an inner threaded stud and an outer threaded stud on each hub strut, a plurality of slots along radially extending edges of each segment fitted over such studs, and a nut securing the segment to each such stud.

23. A fan according to claim 19 wherein the edges of adjacent segments overlap and at least a portion of the slots in adjacent segments are on the same stud.

24. A fan according to claim 19 wherein the slots in adjacent segments each are parallel to a radial centerline of the respective segment.

25. A fan according to claim 16 wherein each segment comprises:

an outer edge with a first wall portion normal to one adjacent hub strut and a second wall portion normal to the other adjacent hub strut.

* * * * *